US005294586A

United States Patent [19]

Sigler

[11] Patent Number: 5,294,586

[45] Date of Patent: Mar. 15, 1994

[54] HYDROGEN-WATER VAPOR PRETREATMENT OF FE-CR-AL ALLOYS

[75] Inventor: David R. Sigler, Shelby Township, Macomb County, Mich.

[73] Assignee: General Motors Corporation, Detroit, Mich.

[21] Appl. No.: 904,289

[22] Filed: Jun. 25, 1992

[51] Int. Cl.[5] ..... B01J 21/04; C23C 8/10

[52] U.S. Cl. ..... 502/439; 148/285

[58] Field of Search ..... 502/439; 148/285

[56] References Cited

U.S. PATENT DOCUMENTS

| | | | |
|---|---|---|---|
| 4,279,782 | 7/1981 | Chapman et al. | 502/439 X |
| 4,318,828 | 3/1982 | Chapman | 252/465 |
| 4,915,751 | 4/1990 | Vaneman et al. | 148/285 X |
| 5,017,544 | 5/1991 | Ikegami et al. | 502/439 |

OTHER PUBLICATIONS

P. Tomaszewicz and G. Wallwork, Oxidation of Metals, vol. 20, Nos. 3/4, 1983, pp. 75–109.

*Primary Examiner*—Paul E. Konopka
*Attorney, Agent, or Firm*—George A. Grove

[57] ABSTRACT

A method is provided for forming a precursor layer of aluminum oxide on a cold-rolled ferritic stainless steel substrate having an aluminum content of less than five weight percent, and more preferably as low as 1.5 weight percent, by exposing the stainless steel to a hydrogen atmosphere containing controlled quantities of water vapor to provide a controlled hydrogen-to-water vapor ratio of less than about 1400. The aluminum can be provided either as a constituent of the ferritic stainless steel chemistry, or it can be provided as a coating on a ferritic stainless steel which contains essentially no aluminum itself. The resulting oxidation environment is extremely oxygen-poor, having a partial pressure of oxygen between about $2.7\times10^{-23}$ and $1.9\times10^{-18}$ atmospheres. In addition, the environment has a relatively high water vapor content of up to about 10,000 ppm. The water vapor serves to replenish the environment's oxygen content, through disassociation of the water vapor, as the oxygen becomes depleted as a result of oxidation of the aluminum in the stainless steel. The above process serves as a pretreatment of the ferritic stainless steel's surface, enabling a subsequent growth of a fully developed layer of aluminum oxide whiskers that provides a surface which promotes adhesion of a catalytically active material to the stainless steel substrate.

20 Claims, No Drawings

HYDROGEN-WATER VAPOR PRETREATMENT OF FE-CR-AL ALLOYS

The present invention generally relates to ferritic stainless steel alloys having an aluminum content which is sufficient for producing an oxidation resistant aluminum oxide layer at elevated temperatures. More particularly, this invention relates to an improved method for growing an aluminum oxide layer on such an alloy wherein the aluminum content of the alloy is below 5 weight percent, and more preferably as low as 1.5 weight percent, and wherein a precursor oxidation step is performed in a H2/H2O atmosphere characterized by a relatively low oxygen partial pressure.

BACKGROUND OF THE INVENTION

In the automotive industry, catalytic converters typically utilize a metal foil monolith structure which supports the catalytically active materials that convert the noxious exhaust gases of an internal combustion engine to harmless gases. Conventionally, the metal foil monolith has a metal foil substrate which is extremely thin, generally on the order of about 0.05 millimeters thick. The hot exhaust gas environment of an internal combustion engine is very severe, and subjects the metal foil to continued thermal cycling which is detrimental to the bond between the metal foil and the catalytically active materials adhered to its surface. To survive in this harsh environment, the metal foil must have excellent oxidation resistance at temperatures exceeding 1000° C. In addition, the metal foil must have suitable surface properties which promote adhesion of the catalytically active materials to its surface.

Currently, the standard foil material used in the automotive production of these monoliths is an Fe-20Cr-5Al alloy. This alloy is extremely oxidation resistant particularly at elevated temperatures because it forms a protective aluminum oxide scale on its surface. As is known in the art, upon exposure to an appropriate atmosphere at elevated temperatures, the relatively high level of aluminum (about five weight percent) within alloys of this type promotes the formation of a protective layer of aluminum oxide crystals, or "whiskers", on the exposed surfaces of the metal foil. Once a suitable layer of aluminum oxide whiskers is obtained, the metal foil is further coated with a catalytically-active gamma alumina washcoat material and this coating is impregnated with a noble metal catalyst. The aluminum oxide whiskers, when present in sufficient quantities to form a dense coverage over the exposed surfaces of the metal foil, provide a suitable surface to which the gamma alumina washcoat can readily adhere.

Preferably, the layer of aluminum oxide whiskers is characterized by being continuous, slow growing and adherent, covering at least about 80 percent, and more preferably at least about 90 percent of the exposed surface. Furthermore, it is preferable that the whiskers are characterized as having a length of at least about 1.5 $\mu$m and possessing an aspect ratio (the ratio between the length and width of the whiskers) of at least about 2 to 1. Notably, metal foils formed from alloys having low levels of aluminum (e.g. below 5 percent weight) are generally unable to produce aluminum oxide having adequate whisker characteristics and adequate surface coverage when oxidized in an $O_2$- rich atmosphere. Furthermore, oxidation of Fe-Cr-Al alloys containing 3% or less of aluminum are known to cause growth of Fe- and Cr-rich oxides which are unsuitable for adhering a catalytic washcoat.

In an effort to promote the growth of aluminum oxide whiskers on a cold-rolled Fe-2OCr-5Al alloy, U.S. Pat. No. 4,318,828 to Chapman, assigned to the assignee of the present invention, proposed a process for forming a precursor layer of aluminum oxide in an oxygen-poor environment, and then further developing a dense layer of aluminum oxide whiskers in a subsequent oxygen-rich environment, such as atmospheric air at an elevated temperature.

The oxygen-poor environment taught by Chapman contained oxygen at partial pressure ($P\text{-}O_2$) levels of between 0.75 and 1.5 torr (0.1 and 0.2 volume percent $O_2$, or less than about 2000 parts per million (ppm)), with the balance of the environment being inert and consisting of nitrogen, hydrogen, carbon dioxide, argon or other noble gases. Chapman maintained that the precursor aluminum oxide layer could not be formed if an atmosphere containing more than about 0.2 volume percent (2000 ppm) of oxygen was present. However, in practice oxidation atmospheres having an oxygen content of 1000 ppm or more have produced little or no whisker growth. In addition, Chapman taught that the oxygen could be introduced by the disassociation of water at the furnace temperatures taught. However, Chapman noted that test results were erratic when using a pure hydrogen environment with a trace of water vapor and having a dew point of about −600° C.—equivalent to a hydrogen-to-water vapor ($H_2/H_2O$) ratio of approximately 100,000. Such an atmosphere is extremely dry, having a water vapor content on the order of 10 ppm or less, and has an extremely low level of available oxygen for formation of the precursor layer of aluminum oxide, corresponding to a partial pressure of oxygen ($P\text{-}O_2$) of approximately $4.9\times10^{-27}$ atmospheres.

Though Chapman was not directed to the problem of forming aluminum oxides with alloys having an aluminum content of less than about 3 weight percent, the automotive industry is continually seeking alternatives to the use of the Fe-20Cr-5Al alloy typically used, primarily in an effort to reduce costs. The high cost of this alloy is principally due to its relatively high aluminum content within the alloy, which significantly reduces the ductility of the material, making the alloy more difficult, and thus more expensive, to process than alloys having an aluminum content of less than about 5 weight percent.

Because of the low ductility of the Fe-20Cr-5Al alloy, relatively inexpensive processing methods such as continuous slab casting, cannot be used in manufacturing the alloy because thermally induced stresses caused by rapid cooling during the continuous casting would cause the alloy slab to crack. Therefore, to avoid cracking, the alloy is almost always ingot cast. However, this is not a preferred alternative, since the tops and bottoms of the cast ingots generally contain gross inhomogeneities and therefore must be removed prior to hot working of the material, resulting in unacceptably poor yields.

Also, the poor ductility of the material due to its high aluminum content further complicates the preparation of the cast ingot surface for subsequent hot working. In order to remove casting defects, so as to obtain a high surface quality, surface grinding must be performed on the material. It is preferred that the surface grinding operation occur at room temperature, where ingot handling and inspection are easier, which results in a markedly better surface finish. Unfortunately, this Fe-20Cr-5Al material must be surface ground at high temperatures in order to avoid ingot cracking which would result from the thermally induced stresses during cooling. High temperature grinding invariably results in a surface finish of poorer quality as compared to a surface which is ground at room temperature.

In addition, the poor surface quality of the cast ingot material coupled with its low ductility cause excessive strip breakage during cold rolling of the alloy. Typically, after final rolling of this material to produce the desired foil, only about 40–60 percent of the original cast ingot is retrieved.

Therefore, what is needed is a method for forming a suitable layer of aluminum oxide whiskers on a metal foil characterized by having an aluminum content of substantially less than five weight percent, such that the material will be capable of providing the requisite adhesion for the catalytic washcoat.

SUMMARY OF THE INVENTION

It is an object of the present invention to provide a ferritic stainless steel material which is characterized by having a surface which is capable of promoting the adherence of a catalytically active material.

It is a further object of this invention that the ferritic stainless steel contain standard amounts of chromium and the normal steel-making impurities, though more particularly with an aluminum content of significantly less than about 5 weight percent, and preferably as low as about 1.5 weight percent. Alternatively, the ferritic stainless steel contains essentially no aluminum itself, but is coated with aluminum.

It is still a further object of this invention that the aluminum content, either present within the ferritic stainless steel or in the form of an aluminum coating on the ferritic stainless steel, is oxidized in a manner that forms a layer of aluminum oxide whiskers so as to be suitable for use as a monolith catalytic converter support.

It is yet another object of this invention that the aluminum content of the ferritic stainless steel is sufficient to produce a layer of aluminum oxide whiskers which will provide a suitable surface to which the catalytically active materials will adhere to the ferritic stainless steel.

In accordance with a preferred embodiment of this invention, these and other objects and advantages are accomplished as follows.

A cold-rolled ferritic stainless steel foil is provided which is suitable for use as an automobile monolith catalytic converter support. The ferritic stainless steel base metal foil consists essentially of, by weight, about 15–25% chromium, along with normal steelmaking impurities. The amount of aluminum within the ferritic stainless steel base metal is significantly less than about 5 weight percent, and more preferably as low as about 1.5 weight percent. Alternatively, the ferritic stainless steel base metal contains essentially no aluminum itself, but is coated with aluminum so as to obtain an average aluminum content within the composite material (which consists of the aluminum coating and the ferritic stainless steel base metal) of preferably less than about 10 weight percent.

Because the base metal has either a low aluminum content or is essentially aluminum-free, the stainless steel base metal alloy of this invention is relatively ductile and can therefore be easily rolled to very thin gauges required for the formation of monolith catalytic converter supports, in contrast to the conventional Fe-20Cr-5Al alloy strip.

To enable the ferritic stainless steel alloy of this invention to grow a surface oxide suitable for washcoat adhesion, the alloy is first exposed to an inert gas environment having approximately five volume percent hydrogen ($H_2$) with water vapor ($H_2O$) in sufficient quantities to provide a controlled $H_2/H_2O$ ratio of less than about 1400. In effect, the present invention provides an extremely oxygen-poor environment, having an oxygen partial pressure of up to about $1.9\times10^{-18}$ atmospheres. In addition, the environment is relatively "wet", having a significantly greater water vapor content than the prior art of up to about 10,000 ppm. The water vapor content of the environment serves as a source for oxygen ($O_2$) which ensures that a relatively constant but extremely low level of $O_2$ is available for oxidation of the aluminum to form the precursor layer of aluminum oxide. Through dissociation of the water vapor, the water vapor content of the oxygen-poor environment is capable of replenishing the environment's oxygen content if the oxygen becomes depleted.

According to a key aspect of the present invention, when exposed to high temperatures in this environment, the ferritic stainless steel alloy quickly forms a precursor layer of aluminum oxide on its exposed surfaces. The precursor layer of aluminum oxide promotes the growth of a fully developed layer of aluminum oxide whiskers which is subsequently formed using standard whisker growth oxidation methods known in the art. The stainless steel alloy is then exposed for a longer period of time to atmospheric air at temperatures sufficient to oxidize the exposed precursor aluminum oxide to fully form the protective layer of aluminum oxide whiskers. The oxide layer is continuous, slow growing and tenaciously adherent to the base metal foil, thereby creating a surface on the stainless steel alloy which is capable of adhering a catalytically active washcoat material.

The oxidation resistance of the stainless steel material of this invention, while somewhat less than that of a conventional Fe-20Cr-5Al alloy currently used within the automotive industry as the catalytic converter monolith support structure, is sufficient for light duty applications, such as diesel engines. In addition, the ductility of the stainless steel material of this invention is superior to that of stainless steels containing greater quantities of aluminum, such as the conventional Fe-20Cr-5Al alloy. As a result, processing of the stainless steel material is much easier.

Therefore, an inventive feature of this material is that the ferritic stainless steel base metal foil contains aluminum in sufficiently low levels to result in a material having increased ductility as compared to the conventional alloys used to form metal foil monolith structures. As a result, the processing costs associated with the alloy of this invention are significantly reduced.

Lastly, following pretreatment in the preferred $H_2/H_2O$ environment, the ferritic stainless steel of this invention exhibits good aluminum oxide whisker growth upon exposure to atmospheric air at elevated temperatures. This is important since it is the aluminum oxide whiskers which carry the subsequently deposited catalytically active materials when used in a catalytic converter environment for conversion of the exhaust gases. Therefore, it is desirable that the material be capable of growing high-aspect ratio oxide whiskers so as to ensure good adherence between the catalytically active materials and the foil.

Other objects and advantages of this invention will be better appreciated from the following detailed description.

DETAILED DESCRIPTION OF THE INVENTION

In accordance with the method of this invention, a precursor layer of aluminum oxide is formed on a cold-rolled ferritic stainless steel substrate having an aluminum content of less than five weight percent, and more preferably as low as about 1.5 weight percent, by exposing the stainless steel to a hydrogen atmosphere containing controlled quantities of It water vapor to provide a controlled $H_2/H_2O$ ratio of less than about 1400. From this precursor layer of aluminum oxide, there can be subsequently grown a fully developed layer of aluminum oxide whiskers whose coverage and whisker length are sufficient to reliably adhere a second layer, such as a catalytically-active gamma alumina washcoat material.

The aluminum can be provided either as a constituent of the ferritic stainless steel chemistry, or it can be provided as a coating on a ferritic stainless steel which contains essentially no aluminum itself. The aluminum coating is applied in sufficient quantities so as to obtain an average aluminum content within the composite material (i.e., the aluminum coating and the ferritic stainless steel) of preferably less than about 10 weight percent. At high temperatures, this aluminum coating simultaneously diffuses into the ferritic stainless steel and oxidizes to form an aluminum oxide protective skin.

In effect, the method of the present invention uses an extremely oxygen-poor environment, though greater than that of the prior art, characterized by a partial pressure of oxygen between about $2.7\times10^{-23}$ and $1.9\times10^{-18}$ atmospheres. In addition, the environment has a relatively high water vapor content, on the order of up to about 10,000 ppm. The water vapor content of the present invention is about 1000 times greater than that known or attempted by the prior art when experimenting with a hydrogen atmosphere. At these levels, the water vapor serves as a buffer which ensures that a relatively constant but extremely low level of oxygen is available for oxidation of the aluminum to form the precursor layer of aluminum oxide. The water vapor serves to replenish the environment's oxygen content, through dissociation of the water vapor, as the oxygen becomes depleted as a result of oxidation of the aluminum in the stainless steel. The above process serves as a pretreatment of the ferritic stainless steel's surface, enabling a subsequent growth of a fully developed layer of aluminum oxide whiskers that provides a surface which promotes adhesion of the catalytically active washcoat material to the stainless steel substrate.

Generally, the pretreatment process of the present invention consists of oxidizing as-cold rolled foil for about 30 seconds at temperatures of between about 800° C. and 1000° C. in an atmosphere with a controlled $H_2/H_2O$ ratio of less than about 1400. Experimentally, a range of preferred atmospheric compositions for the pretreatment environment was created in a stainless steel retort. The atmospheric compositions were controlled by passing argon (Ar) with a 5 volume percent hydrogen ($H_2$) content through a bubbler containing distilled water. While Ar was used, it will be well understood by those skilled in the art that other inert atmospheres would also be suitable, such as nitrogen or other noble gases. The principle behind using a low hydrogen content in an inert atmosphere during testing was to reduce the hazards associated with hydrogen.

The humidified Ar-5% $H_2$ mixture was then diluted with a dry Ar-5% $H_2$ mixture to obtain the desired $H_2/H_2O$ ratios. Gas flow rates were controlled to be about 8.7 standard cubic feet per hour at room temperature. Atmospheric water vapor content was monitored going into and coming out of the stainless steel retort using a chilled mirror dew point sensor. Following pretreatment where the precursor layer of aluminum oxide was formed, the samples were further oxidized for whisker growth in a box furnace using standard whisker growth oxidation cycles known in the art—i.e. about 16 hours in air at about 9250° C. and at atmospheric pressure.

During experiments conducted to assess the capabilities of the pretreatment process on 20% chromium steel sample pieces, the form in which the aluminum was provided (as a constituent of the alloy or as a coating), the aluminum content and the $H_2/H_2O$ ratio of the pretreatment atmosphere were varied to generate results which identify minimum atmospheric compositions for given stainless steel chemistries. Atmospheric conditions are given in terms of water vapor ($H_2O$) in parts per million of (ppm), the $H_2/H_2O$ ratio, and the partial pressure of oxygen ($P\text{-}O_2$) in atmospheres (atm).

For comparison, three conventional pretreatments at 900° C. for 30 seconds, similar to that taught by Chapman, were also conducted. One such treatment consisted of exposing the samples to an environment containing 100 ppm $O_2$ in $N_2$. The second conventional treatment consisted of exposing the samples to an environment containing 10 ppm $O_2$ in $N_2$, while the third conventional treatment consisted of exposing the samples to an environment containing $CO_2$.

Whisker coverage of the samples was estimated from backscatter electron micrographs taken at a magnification of 35×, while whisker size was estimated from 5000× or 10,000× magnification micrographs taken at an angle of 25° from normal. The criterion for assessing the sufficiency of the final aluminum oxide whisker layers was a whisker length of at least about 1.5 /μm and coverage of at least 90 percent of the sample surface. In addition, an aspect ratio of at least 2 is preferred for purposes of providing a surface which promotes the adhesion of the catalytically active materials to the stainless steel substrate.

TABLE 1

Whisker Coverage (%) and Size (μm) For Fe—Cr—Al Alloys

| | Conventional Methods | | | | | | |
|---|---|---|---|---|---|---|---|
| | % Al Content | | | | | | |
| Pretreatment Atmosphere | 4.9% | 4.0% | 3.0% | 2.45% | 2.0% | 1.68% | 1.5% |
| 100 ppm $O_2$ in $N_2$ | >95 | >95 | 95 | 95 | 70 | — | 0 |
| | 2-3 | 3-4 | 2-4 | 2-3 | 1-2 | — | none |
| 10 ppm $O_2$ in $N_2$ | >95 | >95 | 95 | 90 | 70 | — | 0 |

TABLE 1-continued

| | | | Whisker Coverage (%) and Size (μm) For Fe—Cr—Al Alloys | | | | | | |
|---|---|---|---|---|---|---|---|---|---|
| | | | 2-3 | 3-4 | 2-4 | 2-4 | 1-2 | — | none |
| $CO_2$ | | | — | — | — | — | — | 0 | 0 |
| | | | — | — | — | — | — | (rosettes) | |
| | | | $H_2/H_2O$ Method | | | | | | |
| $H_2O$ Content | $H_2/$ | P—$O_2$ | % Al Content | | | | | | |
| (ppm) | $H_2O$ | (atm) | 4.9% | 4.0% | 3.0% | 2.45% | 2.0% | 1.68% | 1.5% |
| 10,000 ± 1000 | 5 | 1.9E-18 | >95 | >95 | >95 | 95 | 80 | — | 20 |
| | | | 3-4 | 2-3 | 2-3 | 2-3 | 1-2 | — | 1 |
| 1080 ± 100 | 46 | 2.3E-20 | >95 | >95 | 95 | 90 | 90 | — | 50 |
| | | | 2-3 | 2-4 | 1-3 | 2-3 | 2-4 | — | 1-2 |
| 690 ± 30 | 72 | 9.3E-21 | — | — | — | — | — | 90 | 50 |
| | | | — | — | — | — | — | 1-2 | 1-2 |
| 370 ± 160 | 135 | 2.7E-21 | — | — | — | — | — | 90 | 40 |
| | | | — | — | — | — | — | 1-2 | 1 |
| 130 ± 40 | 380 | 3.3E-22 | — | — | — | — | — | 90 | 70 |
| | | | — | — | — | — | — | 1-2 | 1-2 |
| 105 ± 10 | 480 | 2.1E-22 | >95 | >95 | 95 | 90 | 90 | — | 90 |
| | | | 2-4 | 3-4 | 2-3 | 2-4 | 2-3 | — | 2-3 |
| 68 ± 20 | 740 | 9.0E-23 | — | — | — | — | — | 90 | 20 |
| | | | — | — | — | — | — | 1-3 | 1 |
| (a) 50 ± 12 | 1000 | 4.9E-23 | — | — | — | — | — | 80 | 90 |
| | | | — | — | — | — | — | 1-2 | 1-3 |
| (b) 37 ± 3 | 1350 | 2.7E-23 | — | — | — | — | — | 90 | 85 |
| | | | — | — | — | — | — | 1-2 | 1-2 |

All pretreatments were conducted at 900° C. for 30 seconds, except:
(a) - Pretreatment time of 2 minutes.
(b) - Pretreatment time of 5 minutes.

TABLE 2

| | | | Whisker Coverage (%) and Size (μm) For Al-Coated Fe—Cr Alloys $H_2/H_2O$ Method | | |
|---|---|---|---|---|---|
| $H_2O$ Content | $H_2/$ | P—$O_2$ | % Al Content | | |
| (ppm) | $H_2O$ | (atm) | 6.8% | 5.9% | 6.3% |
| 3000 | 17 | 1.7E-19 | 80 | 80 | >95 |
| | | | 1-3 | 3-5 | 1-3 |
| 1050 ± 70 | 48 | 2.1E-20 | 95 | 90 | >95 |
| | | | 1-4 | 2-4 | 1-3 |
| 101 ± 14 | 500 | 2.0E-22 | 95 | 90 | >95 |
| | | | 2-4 | 2-4 | 1-3 |
| (a) 53 ± 6 | 940 | 5.5E-23 | >95 | >95 | >95 |
| | | | 2-4 | 3-5 | 1-4 |
| (b) 11 ± 2 | 4500 | 2.4E-24 | 70 | 70 | 0 |
| | | | 1-3 | 2-4 | Coral-like |

All pretreatments were conducted at 900° C. for 30 seconds, except:
(a) - Pretreatment time of 5 minutes.
(b) - Pretreatment time of 30 minutes.
Prior to coating:
The 6.8% alloy contained 20.3% Cr and 0.015% rare earth elements.
The 5.9% alloy contained 20.3% Cr and 0.128% rare earth elements.
After coating:
The 6.3% alloy contained 10.2% Cr, 0.2% Ti and 0.12% Zr.

From Table 1 above, it can be seen that, for the Fe-Cr-Al stainless steel chemistries having less than 2.45 weight percent Al, the conventional pretreatments (100 ppm and 10 ppm $O_2$ in $N_2$) exhibited whisker growth and coverage which were inadequate (i.e. less than about 1.5 μm in length and less than about 90% coverage). In addition, coarse Fe- and Cr-rich oxides were formed which are unsuitable for adhering the catalytically-active washcoat. Between Al contents of about 2.45 and 4.9 weight percent, the $O_2$ in $N_2$ pretreatment methods produced good whisker growth, exhibiting high-aspect-ratio whiskers with good coverage. Results from pretreatment of the 1.68% and 1.5% Al alloys with $CO_2$ produced an aluminum oxide covering roughly 80 percent of the sample surface, but the oxide was flat with sparse oxide rosettes instead of high-aspect-ratio whiskers. Accordingly, the $CO_2$ pretreatment did not produce a layer of aluminum oxide upon which could be grown a fully developed layer of aluminum oxide whiskers.

For alloys containing aluminum at levels of 2.5% and higher, the Ar-5% $H_2$ pretreatment method of the present invention was capable of producing a precursor layer of aluminum oxide which was comparable to that of the conventional methods. The aluminum oxide whiskers were high-aspect-ratio with good coverage. In addition, varying the $H_2/H_2O$ ratio between 5 and 480 had only a minor effect on the coverage of the sample surfaces.

In contrast to that of the conventional methods, for alloys containing aluminum at levels of 2.0% and less, the Ar-5% $H_2$ pretreatment method markedly improved whisker growth. For the 2.0% Al alloy, good whisker growth was obtained with $H_2/H_2O$ ratios between 46 and 480. Some degradation in whisker quality occurred at a $H_2/H_2O$ ratio of 5 from formation of Fe- and Cr-rich oxides. At H 2/H 20 ratios between 72 and 740, the alloy containing aluminum at levels of about 1.68% exhibited good whisker growth behavior. Generally then, the pretreatment of this invention is capable of producing suitable whisker growth when conducted for a duration of less than or equal to about 30 seconds using a $H_2/H_2O$ ratio of less than or equal to about 740 and an oxygen partial pressure of greater than or equal to about $0.9\times10^{-23}$ atmospheres. At higher $H_2/H_2O$ ratios, the pretreatment method was not as successful. However, for the $H_2/H_2O$ ratios of 1000 and 1350, increasing the pretreatment time from 30 seconds as long as about to 2 and 5 minutes, respectively, produced good precursor oxides. Accordingly, it appears that the pretreatment of this invention is capable of producing suitable whisker growth when conducted for a duration of less than or equal to about two minutes for a $H_2/H_2O$ ratio of less than or equal to about 1000 and an oxygen partial pressure of greater than or equal to about $4.9\times10^{-23}$ atmospheres, and when conducted for a duration of less than or equal to about five minutes for a $H_2/H_2O$ ratio of less than or equal to about 1350 and an oxygen partial pressure of greater than or equal to about $2.7\times10^{-23}$ atmospheres. In addition, it is foreseeable that a good precursor oxide layer can be formed using even higher $H_2/H_2O$ ratios if the pretreatment time is of sufficient duration.

The 1.5% aluminum alloy was more sensitive to low $H_2/H_2O$ ratios. At a ratio of 480, this alloy showed good whisker growth. However, at ratios below 480 whisker growth quality degraded, particularly as a result from the formation of Fe- and Cr-rich oxides. At high $H_2/H_2O$ ratios, the 1.5% aluminum alloy exhibited the same sensitivity as the 1.68% aluminum alloy. Results for the pretreatment of the 1.5% and 1.68% aluminum alloys at high $H_2/H_2O$ ratios (1000 and 1350) indicate that pretreatment in hydrogen with a low water vapor level, as suggested by Chapman (an $H_2/H_2O$ ratio of 100,000) would not be successful.

In effect, each of the conventional pretreatment methods (100 ppm and 10 ppm $O_2$ in $N_2$, $CO_2$) were inferior to the method of the present invention at aluminum contents below about 2.45 weight percent. At greater aluminum contents, the Ar-5% $H_2$ method of the present invention produced comparable results to the conventional pretreatment methods.

As can be seen in Table 2, the Ar-5% $H_2$ pretreatment method of the present invention was also capable of producing a precursor layer of aluminum oxide on the aluminum coated Fe-Cr alloys which was comparable to that of the conventional methods in that high-aspect-ratio aluminum oxide whiskers were grown with good coverage. In addition, varying the $H_2/H_2O$ ratio between 48 and 940 had only a minor effect on the coverage of the sample surfaces.

The aluminum-coated alloys pretreated according to the Ar-5% $H_2$ method exhibited whisker growth comparable to that of Fe-Cr-Al samples which contained about 2.45 weight percent or more aluminum and which were pretreated according to conventional methods using an $O_2$ in N atmosphere. The 6.8 and 5.9% samples exposed to an atmosphere having a $H_2/H_2O$ ratio of about 17 exhibited some degradation in whisker formation, while there was no apparent adverse effect on the 6.3% sample. However, a $H_2/H_2O$ ratio of about 4500 exhibited marked degradation in all of the aluminum-coated samples tested. The 6.3% alloy appeared to be most sensitive to high $H_2/H_2O$ ratios in that no aluminum oxide whisker growth occurred at all at an $H_2/H_2O$ ratio of 4500. Accordingly, aluminum-coated alloys pretreated in accordance with this invention appear to exhibit limited whisker growth when using a $H_2/H_2O$ ratio of less than or equal to about 4500 and an oxygen partial pressure of greater than or equal to about $2.4\times10^{-24}$ atmospheres, and exhibit good whisker growth when using a $H_2/H_2O$ ratio of less than or equal to about 940 and an oxygen partial pressure of greater than or equal to about $5.5\times10^{-23}$ atmospheres.

From the above, it can be generally stated that the Ar-5% $H_2$ method of the present invention produced comparable results to the conventional pretreatment methods of samples with aluminum contents greater than 2.45 weight percent using an $O_2$ in $N_2$ atmosphere, as long as the $H_2O$ content was greater than about 11 ppm, corresponding to a $H_2/H_2O$ ratio of less than about 4500 and an oxygen partial pressure of greater than about $2.4\times10^{-24}$ atmospheres.

Based upon the above results, the method of the present invention can be characterized as a suitable pretreatment for forming a precursor layer of aluminum oxide on a ferritic stainless steel containing aluminum at levels as low as about 1.5 weight percent and on a ferritic stainless steel which contains no aluminum but which is coated with aluminum. The pretreatment method yields a precursor aluminum oxide layer from which a layer of aluminum oxide whiskers can be grown to provide a surface suitable for adhering the catalytically-active washcoat to the ferritic stainless steel. The pretreatment method encompasses controlling the level of water vapor in a hydrogen atmosphere so as to control the $H_2/H_2O$ ratios. The oxygen disassociated from the $H_2/H_2O$ atmosphere reacts with the aluminum present in the ferritic stainless steel to produce a precursor aluminum oxide layer in a relatively short time at 900° C. In addition, the high water vapor content simplifies atmospheric control in that wider ranges of atmospheric compositions are capable of producing suitable results.

Successful pretreatment requires limitations on both the upper and lower $H_2/H_2O$ ratios. The lower ratio (higher water vapor content) atmospheres are sensitive to alloy composition. Alloys containing about 5% to as low as about 2.5% aluminum can be successfully pretreated in atmospheres with ratios as low as 5 (oxygen partial pressures of $1.9\times10^{-18}$ atmospheres), while alloys containing lower aluminum contents cannot be pretreated at such high water vapor levels. Successful pretreatment using high $H_2/H_2O$ ratio (lower water vapor content) atmospheres is generally limited by the rate of growth of the precursor oxide. Restrictions on the upper ratio appear to be independent of the aluminum content of the alloy. Tests on the 1.5% and 1.68% aluminum alloys indicate that the maximum ratios for successful pretreatment depend on the time and are about 480 for 30 second pretreatments, 1000 for 2 minute pretreatments, and 1350 for 5 minute pretreatments.

From the above, it can be seen that a significant advantage to the method of the present invention is that a suitable metal foil monolith structure can be formed from a ferritic stainless steel containing aluminum in sufficiently low levels to result in a material having increased ductility as compared to the conventional alloys used to form metal foil monolith structures. Therefore the processing costs associated with the preferred alloy of this invention are significantly reduced.

Another significant advantage is that, following pretreatment in the preferred $H_2/H_2O$ environment, the ferritic stainless steel of this invention exhibits good aluminum oxide whisker growth upon exposure to atmospheric air at elevated temperatures. This is important since it is the aluminum oxide whiskers which carry the subsequently deposited washcoat and catalytically active materials when used in a catalytic converter environment for conversion of the exhaust gases. Therefore, it is desirable that the material be capable of growing high-aspect ratio oxide whiskers so as to ensure good adherence between the catalytically active materials and the foil.

In addition, the preferred pretreatment atmosphere has a relatively wide range of acceptable atmospheric compositions which will yield suitable precursor aluminum oxide growth on the ferritic stainless steel foil. Generally, a 30 second exposure to an environment having a $H_2/H_2O$ ratio of up to about 500 is suitable for obtaining whisker growth on ferritic stainless steels having an aluminum content as low as about 1.68 weight percent. Over exposure times of between about 2 to 5 minutes, $H_2/H_2O$ ratios of greater than about 500 and less than about 1400 are suitable for obtaining whisker growth on ferritic stainless steels having an aluminum content as low as about 1.5 weight percent.

While our invention has been described in terms of a preferred embodiment, it is apparent that other forms could be adopted by one skilled in the art, for example by modifying the processing parameters such as the temperatures or durations employed, or by substituting appropriate ferritic stainless steel materials, or by slightly altering the compositions of the pretreatment atmospheres while still realizing the benefit of a very low oxygen content in a $H_2/H_2O$ atmosphere. Accordingly, the scope of our invention is to be limited only by the following claims.

The embodiments of the invention in which an exclusive property or privilege is claimed are defined as follows:

1. A method for forming an aluminum oxide film on a substrate formed from a material selected from the group consisting of a steel comprising from about 1.5 weight percent to less than about five weight percent aluminum and an aluminum-coated steel having an average aluminum content of less than about 10 weight percent, said method comprising the steps of:

exposing said substrate to an atmosphere having as its reactive portion a mixture consisting essentially of hydrogen and greater than about 11 ppm water vapor such that said atmosphere has a $H_2/H_2O$ ratio productive of an oxygen partial pressure sufficient to oxidize aluminum present at the surface of said substrate, wherein said $H_2/H_2O$ ratio is less than about 4500;

whereby said step of exposing is a pretreatment step to promote subsequent whisker formation during oxidation of said substrate.

2. A method for forming an aluminum oxide film as recited in claim 1 wherein said exposing step is conducted at a temperature of between about 800° C. and 1000° C.

3. A method for forming an aluminum oxide film as recited in claim 1 wherein said substrate is exposed to said atmosphere for a duration of less than or equal to about five minutes.

4. A method for forming an aluminum oxide film as recited in claim 1 wherein said atmosphere is substantially at atmospheric pressure.

5. A method for forming an aluminum oxide film as recited in claim 1 wherein said aluminum constitutes from about 1.5 weight percent to less than about five weight percent of said substrate, and wherein said $H_2/H_2O$ ratio is less than or equal to about 1350 and said oxygen partial pressure is greater than or equal to about $2.7\times10^{-23}$ atmospheres.

6. A method for forming an aluminum oxide film as recited in claim 1 wherein said aluminum is an aluminum coating on said substrate so as to form an aluminum-coated substrate, said aluminum coating being an adherent aluminum layer, and wherein said $H_2/H_2O$ ratio is less than or equal to about 940 and said oxygen partial pressure is greater than or equal to about $5.5\times10^{-23}$ atmospheres.

7. A method for forming an aluminum oxide film as recited in claim 1 wherein said substrate is a ferritic stainless steel foil.

8. A method for forming an aluminum oxide film on a substrate formed from a material selected from the group consisting of a steel comprising from about 1.5 weight percent to less than about five weight percent aluminum and an aluminum-coated steel having an average aluminum content of less than about 10 weight percent, said method comprising the steps of:

exposing a surface of said substrate to an atmosphere having as its reactive portion a mixture consisting essentially of hydrogen and greater than about 11 ppm water vapor at a temperature of between about 800° C. and 1000° C., wherein said atmosphere has a $H_2/H_2O$ ratio productive of an oxygen partial pressure sufficient to oxidize the aluminum constituent at said surface of said substrate so as to form a precursor aluminum oxide on said surface, wherein said $H_2/H_2O$ ratio is less than or equal to about 1350 and said oxygen partial pressure is greater than or equal to about $2.7\times10^{-23}$ atmospheres; and oxidizing said surface of said substrate at an elevated temperature to form said aluminum oxide film from said precursor aluminum oxide layer on said surface of said substrate;

whereby said step of exposing is a pretreatment step to promote subsequent aluminum oxide whisker formation during said step of oxidizing said surface of said substrate.

9. A method for forming an aluminum oxide film as recited in claim 8 wherein said exposing step is conducted for a duration of less than or equal to about five minutes.

10. A method for forming an aluminum oxide film as recited in claim 8 wherein said atmosphere is substantially at atmospheric pressure.

11. A method for forming an aluminum oxide film as recited in claim 8 wherein said oxygen partial pressure is from about $2.7\times10^{-23}$ atmospheres to about $1.9\times10^{-18}$ atmospheres.

12. A method for forming an aluminum oxide film as recited in claim 8 wherein said exposing step is conducted for a duration of less than or equal to about 30 seconds for a $H_2/H_2O$ ratio of less than or equal to about 740 and an oxygen partial pressure of greater than or equal to about $9.0\times10^{-23}$ atmospheres.

13. A method for forming an aluminum oxide film as recited in claim 8 wherein said exposing step is conducted for a duration of less than or equal to about five minutes for a $H_2/H_2O$ ratio of less than or equal to about 1350 and an oxygen partial pressure of greater than or equal to about $2.7\times10^{-23}$ atmospheres.

14. A method for forming an aluminum oxide film as recited in claim 8 wherein said exposing step is conducted for a duration of less than or equal to about two minutes for a $H_2/H_2O$ ratio of less than or equal to about 1000 and an oxygen partial pressure of greater than or equal to about $4.9\times10^{-23}$ atmospheres.

15. A method for forming an aluminum oxide film on a monolithic support structure for treating the exhaust gases of an internal combustion engine, said method comprising the steps of:

providing said monolithic support structure formed from a material selected from the group consisting of a steel comprising from about 1.5 weight percent to less than about five weight percent aluminum and an aluminum-coated steel having an average aluminum content of less than about 10 weight percent;

exposing a surface of said monolithic support structure to an atmosphere having as its reactive portion a mixture consisting essentially of hydrogen and greater than about 11 ppm water vapor at a temperature of between about 800° C. and 1000° C., wherein said atmosphere has a $H_2/H_2O$ ratio of less than or equal to about 1350 so as to be productive of an oxygen partial pressure sufficient to form a precursor aluminum oxide on said surface; and oxidizing said surface at an elevated temperature to form said aluminum oxide film from said precursor aluminum oxide layer on said surface;

whereby said step of exposing is a pretreatment step to promote subsequent aluminum oxide whisker formation during said step of oxidizing said surface.

16. A method for forming an aluminum oxide film as recited in claim 15 wherein said aluminum is present as an aluminum coating on said surface so as to form an aluminum-coated substrate, said aluminum coating being an adherent aluminum layer, and wherein said atmosphere has a $H_2/H_2O$ ratio of less than or equal to about 940 and said oxygen partial pressure is greater than or equal to about $5.5\times10^{-23}$ atmospheres.

17. A method for forming an aluminum oxide film as recited in claim 15 wherein said steel of said monolithic support structure is a ferritic stainless steel foil.

18. A method for forming an aluminum oxide film as recited in claim 15 wherein said exposing step is conducted for a duration of less than or equal to about five minutes.

19. A method for forming an aluminum oxide film as recited in claim 15 wherein said atmosphere is substantially at atmospheric pressure.

20. A method for forming an aluminum oxide film as recited in claim 15 wherein said oxygen partial pressure is from about $2.7\times10^{-23}$ atmospheres to about $1.9\times10^{-18}$ atmospheres.

* * * * *